US007281678B2

(12) United States Patent
Matsugi

(10) Patent No.: US 7,281,678 B2
(45) Date of Patent: Oct. 16, 2007

(54) DECURL UNIT AND PRINTING DEVICE

(75) Inventor: Hironori Matsugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

(21) Appl. No.: 10/934,045

(22) Filed: Sep. 3, 2004

(65) Prior Publication Data

US 2005/0098674 A1 May 12, 2005

(30) Foreign Application Priority Data

Sep. 3, 2003 (JP) ..... 2003-311102

(51) Int. Cl.
*B65H 23/00* (2006.01)

(52) U.S. Cl. ..... 242/548; 242/566; 242/547; 242/422.5

(58) Field of Classification Search ..... 242/566, 242/548, 547, 417.3, 422.5
See application file for complete search history.

(56) References Cited

U.S. PATENT DOCUMENTS 4,111,745 A * 9/1978 Manfredi ..... 162/271

FOREIGN PATENT DOCUMENTS

JP 56043153 A * 4/1981
JP 02147549 A * 6/1990
JP 09-025036 1/1997
JP 2000095403 A * 4/2000

OTHER PUBLICATIONS

Abstract of Japanese Patent Publication 09-025036, Pub. Date: Jan. 28, 1997, Patent Abstracts of Japan.

* cited by examiner

*Primary Examiner*—Gene O Crawford
*Assistant Examiner*—Sang Kim
(74) *Attorney, Agent, or Firm*—Martine Penilla & Gencarella, LLP

(57) ABSTRACT

A decurl roller 22 of a decurl unit 20 is an axially rotatable member that eliminates curl of printing paper 24 drawn out of roll paper holders 21*b*. The decurl roller 22 is pressed by tension springs 23*b*, which are respectively spanned between the periphery of a roll paper shaft 21*a* of roll paper 21 and a roller shaft 22*a* of the decurl roller 22, to be continuously in contact with a cylindrical face of the roll paper 21 wound in a cylindrical roll. The decurl roller 22 moves to approach the roll paper shaft 21*a* with a decrease in remaining amount of the roll paper 21. As the remaining amount of the roll paper 21 decreases, the decurl roller 22 linearly moves along guide rails 23*c*, which are formed in support members 23*a*, toward an eccentric position from the roll paper shaft 21*a* to increase a contact area and a contact angle ∠PQR of the decurl roller 22 with the printing paper 24.

10 Claims, 7 Drawing Sheets

DECURL UNIT AND PRINTING DEVICE

BACKGROUND OF THE INVENTION

1. Field of the Invention

The present invention relates to a decurl unit and a printing device.

2. Description of the Prior Art

One proposed decurl unit attached to a printing device, which uses recording roll paper as a printing medium, is capable of adequately eliminating curl with a decrease in remaining amount of the roll paper. For example, in a decurl unit 50 disclosed in Japanese Patent Laid-Open Gazette No. 9-25036 (see FIG. 7), a support member 522*a* is attached to a pivot shaft 522*b* in a rotatable manner to support a decurl roller 522. A torque clutch (not shown) works to transmit a practically constant torque to the pivot shaft 522*b*. As the remaining amount of roll paper 521 decreases (see the one-dot chain line in FIG. 7), the torque clutch rotates the pivot shaft 522*b* and moves the decurl roller 522 in a direction to be pressed against the roll paper 521 (that is, in a direction of an arrow F in FIG. 7). This action eliminates curl of the roll paper 521 passing through the decurl roller 522.

In the prior art decurl unit 50, however, the decurl roller 522 rotates about the pivot shaft 522*b*, as the remaining amount of the roll paper 521 decreases. An extra space is thus required between the roll paper 521 and conveyance rollers 525 for rotation of the decurl roller 522. This undesirably interferes with size reduction of the whole decurl unit.

SUMMARY OF THE INVENTION

An object of the present invention is to contribute to total size reduction of a decurl unit and a printing device.

In order to achieve at least part of the above object, the present invention is constructed as follows.

The present invention is directed to a decurl unit that eliminates curl of roll paper, said decurl unit comprising: a roll paper holder that holds roll paper, which is wound in a cylindrical roll, in an axially rotatable manner; a conveyance roller that feeds the roll paper drawn out of said roll paper holder; a curl elimination module that comes in contact with the roll paper drawn out of said roll paper holder to apply tension onto the drawn-out roll paper in a decurling direction; and a shift mechanism that presses said curl elimination module to bring said curl elimination module substantially into contact with a cylindrical face of the roll paper wound in the cylindrical roll, and moves said curl elimination module to approach a roll paper shaft of the roll paper with a decrease in remaining amount of the roll paper.

In the decurl unit of the invention, the decurl roller is substantially in contact with the cylindrical face of the roll paper, which is wound in the cylindrical roll. As the remaining amount of the roll paper decreases to reduce the radius of the roll paper wound in the cylindrical roll, the curl elimination module follows the reducing radius of the roll paper and eliminates the curl of the roll paper. This arrangement does not require any extra space for rotation of the curl elimination module to eliminate the curl of the roll paper and thus contributes to the total size reduction.

In the decurl unit of the invention, said curl elimination module may be located between said roll paper holder and said conveyance roller.

In the decurl unit of the invention, said curl elimination module may apply the tension onto the drawn-out roll paper in a direction from a side without said roll paper holder to a side with said roll paper holder relative to a virtual line connecting an outer circumference of the roll paper held on said roll paper holder and a draw-in position of the roll paper into said conveyance roller.

In the decurl unit of the invention, said curl elimination module may be an axially rotatable decurl roller.

Furthermore, in the decurl unit of the invention, said shift mechanism may be a tension spring that is spanned between said curl elimination module and the roll paper shaft or its periphery.

In the decurl unit of the invention, said shift mechanism may have a pressing member that presses said curl elimination module against the roll paper shaft, and a guide rail that moves said curl elimination module to approach the roll paper shaft.

In the decurl unit of the invention, said shift mechanism may move said curl elimination module to approach the roll paper shaft and thereby increase a contact area of said curl elimination module with the roll paper, as the remaining amount of the roll paper decreases.

In the decurl unit of the invention, the shift mechanism may move the curl elimination module to approach the roll paper shaft and thereby increase a contact angle ∠PQR of the curl elimination module with the roll paper. Here, the contact angle ∠PQR is defined by a position P where the roll paper drawn out of the roll paper holder comes into contact with the curl elimination module, a center position Q of the curl elimination module, and a position R where the roll paper moves away from the curl elimination module, as the remaining amount of the roll paper decreases. The inner roll of the roll paper naturally has the tighter curl. The increase in contact angle ∠PQR of the curl elimination module with the roll paper with a decrease in remaining amount of the roll paper thus effectively eliminates the tighter curl of the roll paper.

In the decurl unit of the invention, said shift mechanism may move said curl elimination module toward the roll paper shaft or toward an eccentric position from the roll paper shaft to approach the roll paper shaft.

Furthermore, in the decurl unit of the invention, said shift mechanism may linearly move said curl elimination module. The shift mechanism otherwise moves said curl elimination module along a kinked line or along a curve.

Furthermore, in the decurl unit of the invention, said shift mechanism may cause a feeding direction of the roll paper from said curl elimination module to said conveyance roller to be substantially identical with a feeding direction of the roll paper fed out of said conveyance roller, and move said curl elimination module practically parallel to the feeding directions of the roll paper to approach the roll paper shaft.

In one preferable embodiment of the invention, said decurl unit may further include a positioning mechanism that sets said curl elimination module in either of a curl elimination position where said curl elimination module is in contact with the roll paper drawn out of said roll paper holder and applies the tension onto the drawn-out roll paper in the decurling direction and a non-curl elimination position where said curl elimination module applies no tension onto the drawn-out roll paper.

In the decurl unit of the invention, the conveyance roller may have two rubber rollers that pressingly clip the roll paper and rotate to feed the roll paper held therebetween.

The present invention is also directed to a printing device that is equipped with the decurl unit in any of the arrangements described above. The present invention is effectively applied to diversity of printing devices including printers, photocopiers, and facsimiles, that are usually equipped with decurl units.

DESCRIPTION OF THE PREFERRED EMBODIMENTS

One mode of carrying out the invention is discussed below as a preferred embodiment with reference to the accompanied drawings.

Figure 1:
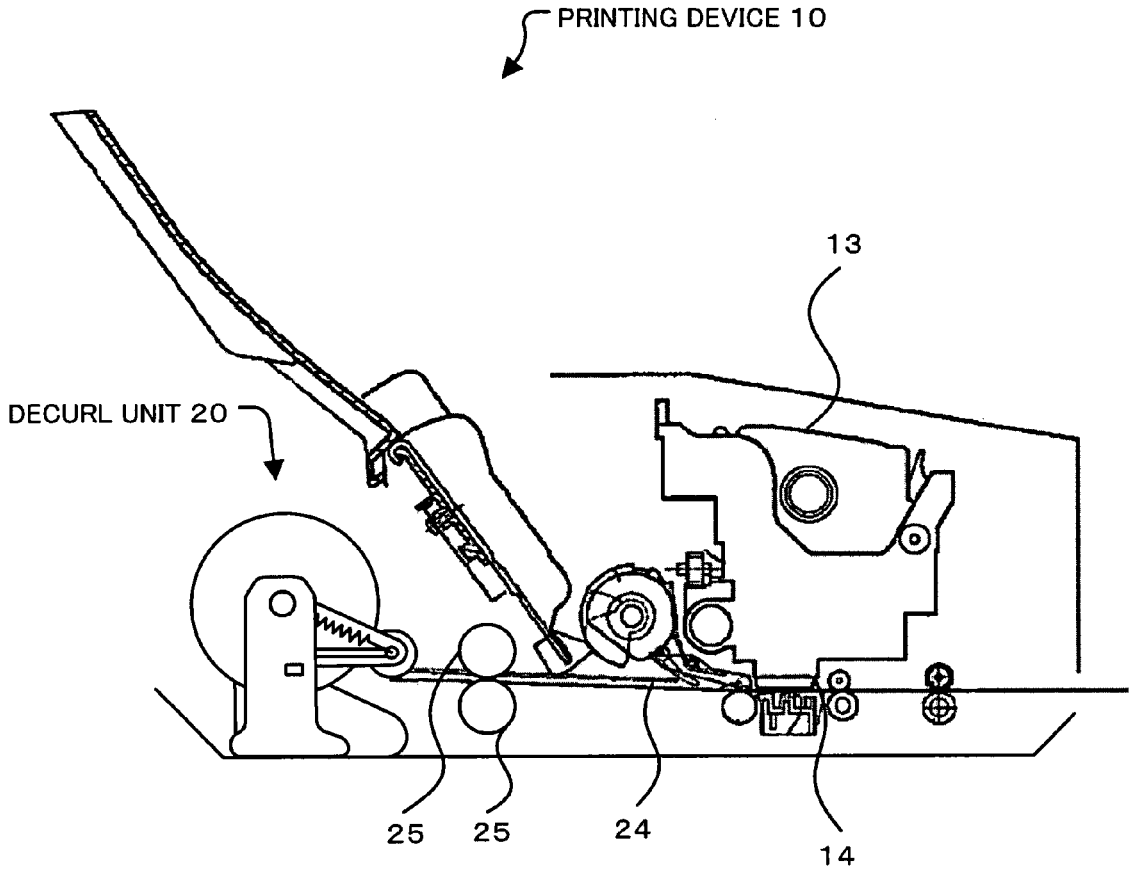
FIG. 1 schematically illustrates the structure of a printing device 10 in one embodiment of the invention.

FIG. 1 schematically illustrates the structure of a printing device 10 in one embodiment of the invention. As shown in FIG. 1, the printing device 10 of the embodiment is an inkjet printer that feeds roll paper 21, which is kept on a decurl unit 20 in a rotatable manner, by means of a pair of conveyance rollers 25, while ejecting ink from a print head 14 of an ink cartridge 13 to print an image on the roll paper 21.

Figure 2:
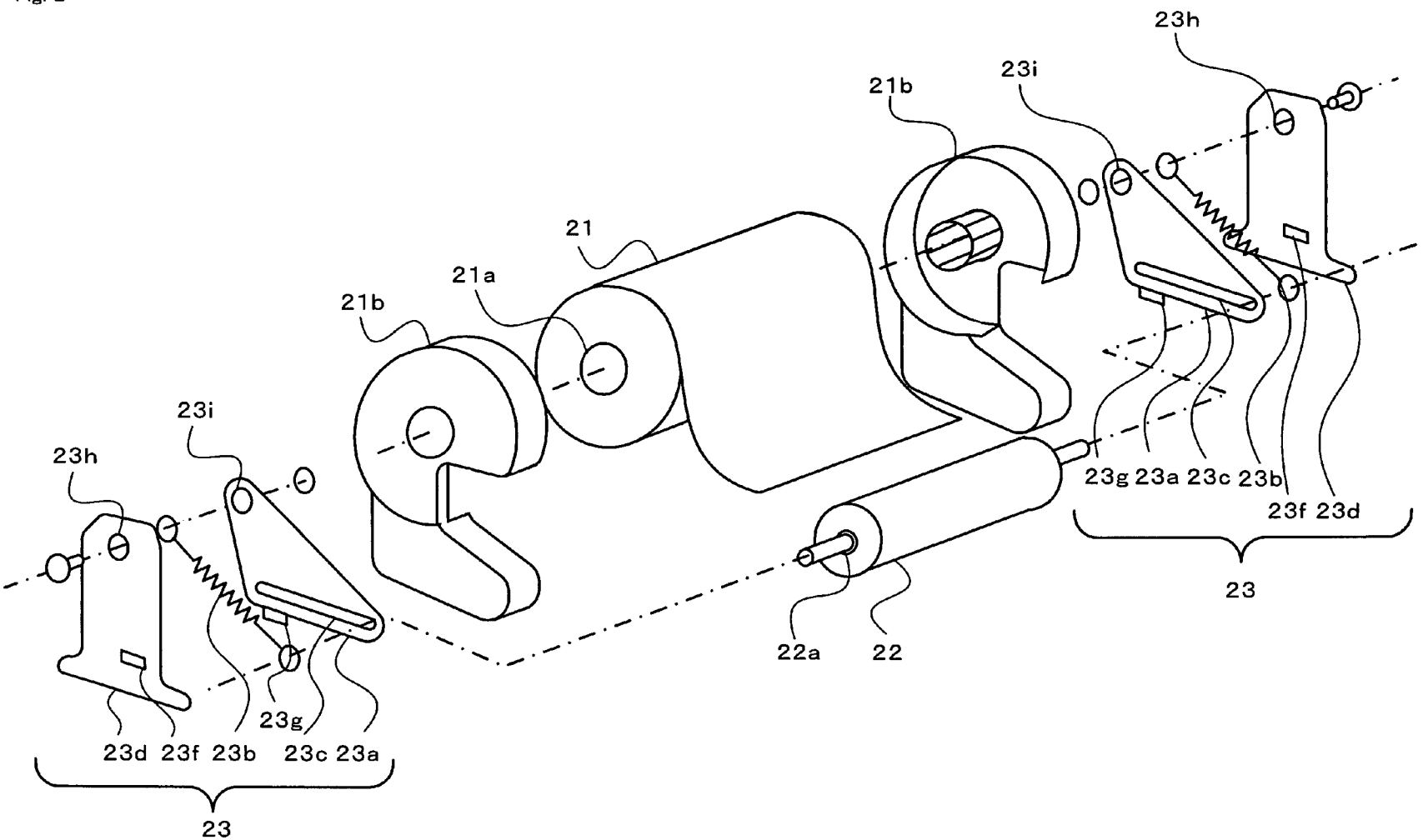
FIG. 2 is a decomposed perspective view of a decurl unit 20.
Figure 3:
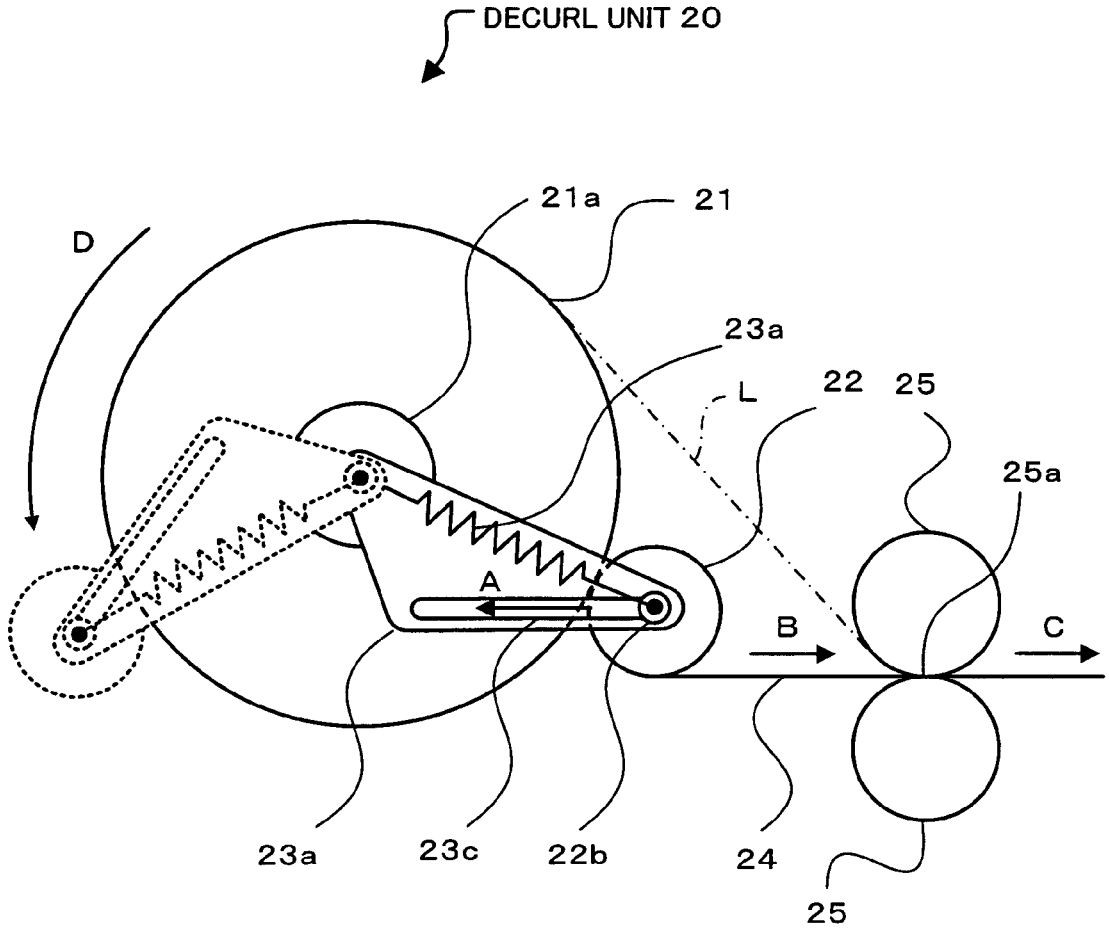
FIG. 3 is a side view of the decurl unit 20.

FIG. 2 is a decomposed perspective view of the decurl unit 20, and FIG. 3 is a side view of the decurl unit 20. The decurl unit 20 has the roll paper 21, a pair of roll paper holders 21*b*, a decurl roller 22, a shift mechanism 23, and the pair of conveyance rollers 25. The roll paper 21 is a cylindrical roll of printing paper 24 as a printing medium, which is wound clockwise on a roll paper shaft 21*a*. For convenience of subsequent explanation, the paper wound in the cylindrical roll is called the roll paper 21, while the paper drawn out of the cylindrical face of the roll paper 21 is called the printing paper 24.

The roll paper holders 21*b* are a pair of resin fixtures placed on the left and right edges of the roll paper 21 to fasten the roll paper 21 to the printing device 10. The roll paper holders 21*b* hold the roll paper 21 to be axially rotatable about the roll paper shaft 21*a* and enable the printing paper 24 to be drawn out of the cylindrical face of the roll paper 21. The roll paper holders 21*b* set in the roll paper 21 are integrally detachable from the printing device 10, for example, for replacement of the roll paper 21.

The decurl roller 22 comes in contact with the printing paper 24 drawn out of the roll paper holders 21*b* to apply tension onto the printing paper 24 in a decurling direction. The decurl roller 22 is held about a roller shaft 22*a* by a pair of support members 23*a* in an axially rotatable and movable manner. As clearly shown in FIG. 3, the decurl roller 22 is located between the pair of roll paper holders 21*b* and the pair of conveyance rollers 25. The decurl roller 22 applies tension onto the roll paper 21 in a direction from a side without the roller paper holders 21*b* to a side with the roller paper holders 21*b* relative to a virtual line L (see FIG. 3), which connects the outer circumference of the roll paper 21 held by the roll paper holders 21*b* and a draw-in position of the roll paper 21 into the conveyance rollers 25. The decurl roller 22 is continuously in contact with the cylindrical face of the roll paper 21 wound in the cylindrical roll to eliminate the curl of the printing paper 24 drawn out of the roll paper 21.

The shift mechanism 23 includes fixing members 23*d* fastened to the printing device 10, quasi-triangular support members 23*a* held by the fixing members 23*d*, and tension springs 23*b* that press the roller shaft 22*a* of the decurl roller 22 against the roll paper shaft 21*a* of the roll paper 21 (see FIG. 2).

Each of the fixing members 23*d* has an extended bottom that is screwed to a bottom face of the printing device 10. The fixing member 23*d* has an upper through hole 23*h*, which is designed to be located on an extension of the roller paper shaft 21*a* of the roll paper 21. The fixing member 23*d* also has a flexible claw 23*f* formed to face the support member 23*a*. The flexible claw 23*f* is vertically moved by vertical manipulation of a claw grip protruded from the outer side face of the fixing member 23*d*.

Each of the support members 23*a* has a guide rail 23*c* extended horizontally along its bottom side, and a catch 23*g* formed to catch and release the flexible claw 23*f* of the fixing member 23*d*. The support member 23*a* also has a through hole 23*i* at an apex of the triangle opposite to the bottom side. The through hole 23*i* of the support member 23*a* is screwed to the through hole 23*h* of the fixing member 23*d* with one end of the tension spring 23*b* interposed therebetween, while the catch 23*g* of the support member 23*a* catches the flexible claw 23*f* of the fixing member 23*d*. The support member 23*a* is accordingly positioned relative to the fixing member 23*d* at a specified attitude (a curl elimination position discussed later). Release of the flexible claw 23*f* of the fixing member 23*d* from the catch 23*g* of the support member 23*a* enables the support member 23*a* to be rotatable about the through hole 23*i*.

One end of the tension spring 23*b* is fastened with a screw to be interposed between the through hole 23*i* of the support member 23*a* and the through hole 23*h* of the fixing member 23*d* as mentioned above. Namely one end of the tension spring 23*b* is fastened to the periphery of the roll paper shaft 21*a* of the roll paper 21. The other end of the tension spring 23*b* is held by the roller shaft 22*a* of the decurl roller 22, which is set in the guide rail 23*c* of the support member 23*a*. The decurl roller 22 is accordingly pressed against the roll paper shaft 21*a* by the tension spring 23*b* and is movable along the guide rail 23*c* to approach the roll paper shaft 21*a*, more specifically movable toward a downward eccentric position from the roll paper shaft 21*a*. The decurl roller 22 is in contact with the printing paper 24 and, in combination with the tension spring 23*b*, applies tension onto the printing paper 24 in the decurling direction. The tension spring 23*b* is designed to have a setting of spring force that continuously brings the decurl roller 22 into contact with the roll paper 21, even when the printing paper 24 is drawn in the feeding direction by the pair of conveyance rollers 25 to receive a force in a direction opposite to the moving direction of the decurl roller 22 (that is, a direction opposite to an arrow A in FIG. 3).

The conveyance rollers 25 are made or rubber and are driven and rotated by a non-illustrated motor. The pair of conveyance rollers 25 pressingly clip the printing paper 24 at a nip 25*a* and feed the printing paper 24 drawn out of the roll paper 21 to the print head 14 via the decurl roller 22 by their rotational force. In the printing device 10 of the embodiment, a feeding direction of the printing paper 24 from the decurl roller 22 to the nip 25*a* of the conveyance rollers 25 (that is, the direction of an arrow B in FIG. 3) is set substantially identical with a feeding direction of the printing paper 24 fed out of the conveyance rollers 25 (that is, the direction of an arrow C in FIG. 3). These feeding directions B and C are set to be parallel to the moving direction of the decurl roller 22 (that is, the direction of the arrow A in FIG. 3).

The following describes the operations of the decurl unit 20 of the embodiment constructed as discussed above with reference to FIG. 4. In the state of a large remaining amount of the roll paper 21, the printing paper 24 is drawn from a position P where the cylindrical face of the roll paper 21 comes into contact with the decurl roller 22, as shown by the solid line of FIG. 4. The contact of the printing paper 24 with the decurl roller 22 starts from this position P. The printing paper 24 moves away from the decurl roller 22 at a position R where the printing paper 24 in contact with the decurl roller 22 faces the nip 25*a*. The decurl roller 22 accordingly keeps in contact with the printing paper 24 between the position P on the outer circumference of the roll paper 21 and the position R and eliminates curl by a contact area S, which is the product of the length of an arc PR and a width L of the printing paper 24. In other words, the decurl roller 22 eliminates curl by an angle ∠PQR=θ1 of the position P, a center position Q of the decurl roller 22, and the position R (hereafter ∠PQR represents an angle formed on the side of the contact of the decurl roller 22 with the printing paper 24).

Figure 4:
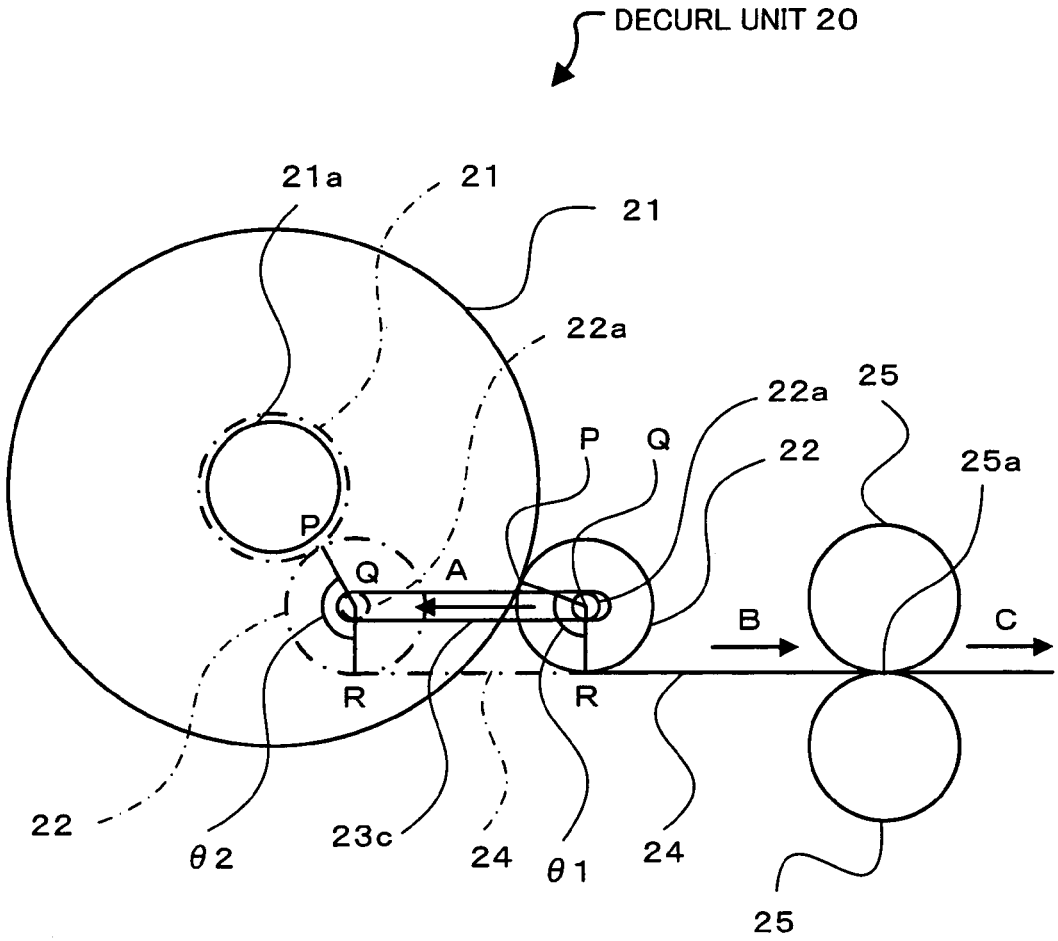
FIG. 4 shows an operation of the decurl unit 20.

As the roll paper 21 is consumed for printing with the printing device 10 and decreases the remaining amount, the decurl roller 22 in contact with the cylindrical face of the roll paper 21 gradually moves along the guide rail 23*c* to approach the roll paper shaft 21*a* (in the direction of the arrow A in FIG. 4). Both the contact area S of the decurl roller 22 with the printing paper 24 and the angle ∠PQR gradually increase with a decrease in remaining amount of the roll paper 21. In the decurl unit 20 of the embodiment, the printing paper 24 away from the decurl roller 22 is conveyed in the same fixed direction through the decurl roller 22, the nip 25*a* of the conveyance rollers 25, and the print head 14 to be fed out of the printing device 10, regardless of the shift of the decurl roller 22 (see FIG. 1).

In the state of a least remaining amount of the roll paper 21, as shown by the one-dot chain line in FIG. 4, the decurl roller 22 keeps in contact with the printing paper 24 between the position P on the outer circumference of the roll paper 21 and the position R and eliminates curl by the contact area S, which is the product of the length of the arc PR and the width L of the printing paper 24. In this state, the contact area S and the contact angle ∠PQR of the decurl roller 22 with the printing paper 24 reach their maxima. Namely the decurl roller eliminates the curl by a maximum angle θ2. In the decurl unit 20 of the embodiment, as the remaining amount of the roll paper 21 decreases to tighten the curl, the decurl roller 22 moves to increase the contact area and the contact angle of the decurl roller 22 with the printing paper 24 and thus effectively eliminates the tighter curl of the roll paper 21.

In the decurl unit 20 of the embodiment, the decurl roller 22 is rotationally moved in a direction opposite to the winding direction of the roll paper 21 (that is, the direction of an arrow D in FIG. 3) and is set in either of a curl elimination position where the claw 23*f* of the fixing member 23*d* is released from the catch 23*g* of the support member 23*a* to apply tension onto the printing paper 24 drawn out of the roll paper 21 and a non-curl elimination position where no tension is applied onto the printing paper 24. The decurl roller 22 is thus rotationally movable to a position that does not interfere with replacement of the roll paper 21 (for example, a position of the support member 23*a* shown by the broken line in FIG. 3).

The roll paper holders 21*b* of the embodiment correspond to the roll paper holder of the invention. The decurl roller 22 and the tension spring 23*b* of the embodiment are respectively equivalent to the curl elimination module and the pressing member of the invention. The catch 23*g* and the claw 23*f* of the embodiment correspond to the positioning mechanism of the invention.

As described above, in the decurl unit 20 of the embodiment, the decurl roller 22 is continuously in contact with the cylindrical face of the roll paper 21 wound in the cylindrical roll. As the remaining amount of the roll paper 21 decreases to reduce the radius of the roll paper 21 wound in the cylindrical roll, the decurl roller 22 follows the reducing radius of the roll paper 21 and eliminates the curl of the roll paper 21. This arrangement does not require any extra space for rotation of the decurl roller 22 to eliminate the curl of the roll paper 21 and thus contributes to the total size reduction.

The member functioning to eliminate the curl is the axially rotatable decurl roller 22. This structure facilitates elimination of the curl without damaging the roll paper.

The shift mechanism 23 includes the tension spring 23*b* that is spanned between the roller shaft 22*a* of the decurl roller 22 and the periphery of the roll paper shaft 21*a* of the roll paper 21, and the guide rail 23*c* that is formed in the support member 23*a*. This relatively simple structure enables the decurl roller 22 to move toward the roll paper shaft 21*a*.

The support member 23*a* moves the decurl roller 22 to approach the roll paper shaft 21*a* and increase the contact area of the decurl roller 22 with the roll paper 21, as the remaining amount of the roll paper 21 decreases. This arrangement desirably increases the contact area of the decurl roller 22 with the roll paper 21 and thus effectively eliminates the tighter curl of the roll paper 21 with a decrease in remaining amount of the roll paper 21.

As the remaining amount of the roll paper 21 decreases, the decurl roller 22 is moved to approach the roll paper shaft 21*a* of the roll paper 21 to increase the angle ∠PQR of the position P where the printing paper 24 drawn out of the roll paper 21 comes into contact with the decurl roller 22, the center position Q of the decurl roller 22, and the position R where the printing paper 24 moves away from the decurl roller 22. This arrangement desirably increases the contact angle ∠PQR of the decurl roller 22 with the roll paper 21 and thus effectively eliminates the tighter curl of the roll paper 21 with a decrease in remaining amount of the roll paper 21.

The guide rail 23*c* linearly moves the decurl roller 22 toward the eccentric position from the roll paper shaft 21*a*. This arrangement moves the decurl roller 22 on the linear orbit and thus ensures the desirable total size reduction.

Figure 7:
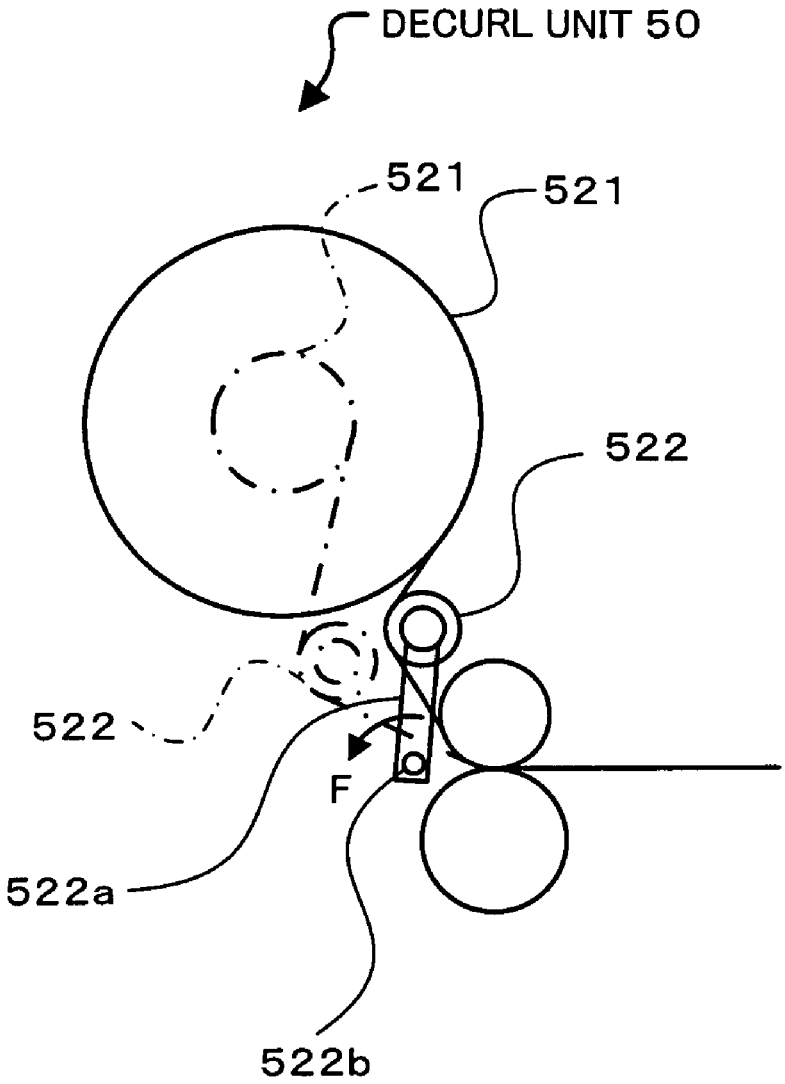
FIG. 7 shows an operation of a decurl unit 50 in the prior art.

The shift mechanism 23 functions to make the feeding direction B of the printing paper 24 substantially identical with the feeding direction C of the printing paper 24 (see FIG. 4), and moves the decurl roller 22 practically parallel to the printing paper 24 to approach the roll paper shaft 21*a*. Unlike the structure of the prior art decurl unit 50 (see FIG. 7), the printing paper 24 is fed in the same fixed direction through the decurl roller 22 to the conveyance rollers 25, while the decurl roller 22 approaches the roll paper shaft 21*a* of the roll paper 21 with a decrease in remaining amount of the roll paper 21. This arrangement effectively prevents the curl-eliminated printing paper 24 from being curled again by the conveyance rollers 25.

The combination of the catch 23*g* of the support member 23*a* with the claw 23*f* of the fixing member 23*d* sets the decurl roller 22 in either of the curl elimination position where the decurl roller 22 is in contact with the printing paper 24 to apply tension onto the printing paper 24 in the decurling direction and the non-curl elimination position where the decurl roller 22 does not apply tension onto the printing paper 24. In a non-service situation of the decurl unit 20, the decurl roller 22 is set in the non-curl elimination position (see, for example, the broken line in FIG. 3) by releasing the claw 23*f* of the fixing member 23*d* from the catch 23*g* of the support member 23*a*. This desirably restrains the printing paper 24 from being curled in the standby conditions. The decurl roller 22 may be moved rotationally to the position that does not interfere with replacement of the roll paper 21. This ensures easy detachment and attachment of the roll paper 21.

The above embodiment is to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

Figure 5:
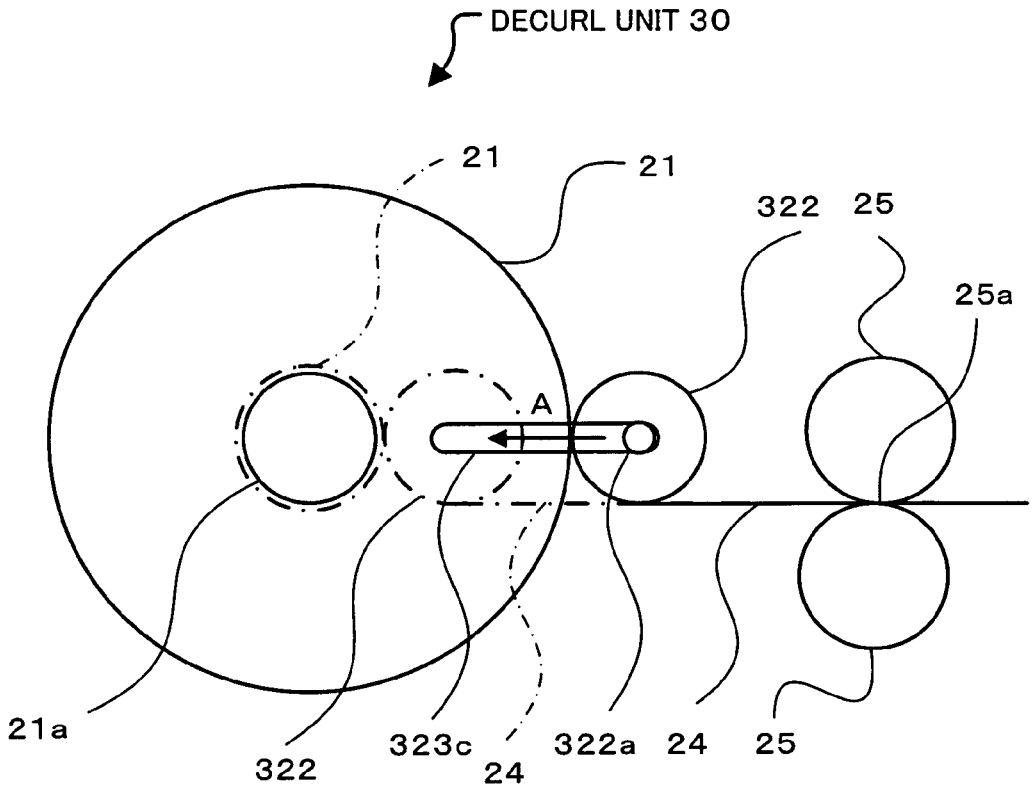
FIG. 5 shows an operation of a decurl unit 30 in one modified structure.

In the structure of the above embodiment, the decurl roller 22 is moved toward the eccentric position from the roll paper shaft 21*a*. In one modified structure, for example, the guide rail may be formed in a radial direction of the roll paper 21 to move the decurl roller 22 toward the roll paper shaft 21*a*. In another modified structure shown in FIG. 5, a guide rail 323*c* is formed to move a decurl roller 322 toward the roll paper shaft 21*a*. This modified arrangement does not require any extra space for rotation of the decurl roller 322 to eliminate the curl of the roll paper 21 and thus contributes to the total size reduction. In the decurl unit 30 of this modified structure, the contact area S or the contact angle ∠PQR of the decurl roller 322 and printing paper 24 does not decrease, regardless of the shift of the decurl roller 322. In this modified structure, a tension spring (not shown) may be spanned between the roll paper shaft 21*a* or its periphery and a roller shaft 322*a* of the decurl roller 322. Support members (not shown) and the guide rails 323*c* may be omitted from this modified structure, when not required.

Figure 6:
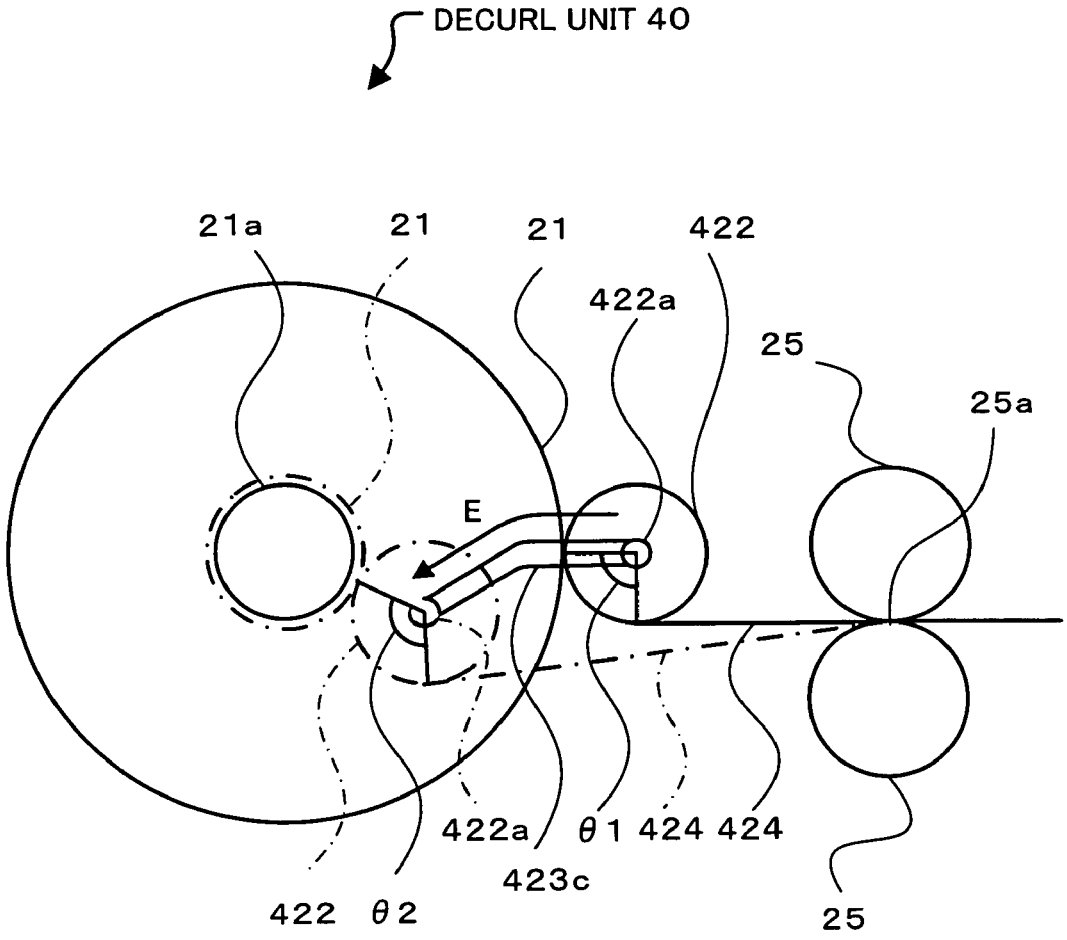
FIG. 6 shows an operation of a decurl unit 40 in another modified structure.

The decurl roller 22 is moved linearly in the structure of the embodiment discussed above, but may be moved to follow a kinked line or a curve. Such modified arrangement does not require any extra space for rotation of the decurl roller to eliminate the curl of the roll paper and thus contributes to the total size reduction. FIG. 6 shows a decurl unit 40, in which a decurl roller 422 moves along a kinked line (the direction of an arrow E in FIG. 6), that is, first moves toward the roll paper shaft 21*a*, changes the moving direction at a bending point, and moves toward an eccentric position from the roll paper shaft 21*a*. In the decurl unit 40 of this modified structure, while the decurl roller 422 moves toward the roll paper shaft 21*a*, the contact area S and the contact angle ∠PQR of the decurl roller 422 with a printing paper 424 are kept constant. The contact area S and the contact angle ∠PQR increase with the further shift of the decurl roller 422 over the bending point. This modified structure regulates the contact area S and the contact angle ∠PQR of the decurl roller 422 with the printing paper 424 by changing the moving direction of the decurl roller 422. In this modified structure, a tension spring (not shown) may be spanned between the periphery of the roll paper shaft 21*a* and a roller shaft 422*a* of the decurl roller 422.

In the structure of the above embodiment, the decurl roller 22 is continuously in contact with the cylindrical face of the roll paper 21. There may be, however, a little clearance (for example, a gap of 1 mm) between the decurl roller 22 and the cylindrical face of the roll paper 21.

In the structure of the above embodiment, the printing device 10 is an inkjet printer. The technique of the present invention is not restricted to the inkjet printers but is also applicable to thermal printers, laser printers, and dot printers, as well as to diversity of printing devices including printers, photocopiers, and facsimiles.

What is claimed is:

1. A decurl unit that eliminates curl of roll paper, said decurl unit comprising:

a roll paper holder that holds roll paper, which is wound in a cylindrical roll, in an axially rotatable manner;

a conveyance roller that feeds the roll paper drawn out of said roll paper holder;

a curl elimination roller that comes in contact with the roll paper drawn out of said roll paper holder to apply tension onto the drawn-out roll paper in a decurling direction, said curl elimination roller being axially rotatable; and a shift mechanism that presses said curl elimination roller to bring said curl elimination roller substantially into contact with a cylindrical face of the roll paper wound in the cylindrical roll, and moves said curl elimination roller to approach a roll paper shaft of the roll paper with a decrease in remaining amount of the roll paper, said shift mechanism being a tension spring that is spanned between said curl elimination roller and said roll paper shaft or its periphery.

2. A decurl unit in accordance with claim 1, wherein said curl elimination roller is located between said roll paper holder and said conveyance roller.

3. A decurl unit in accordance with claim 1, wherein said shift mechanism moves said curl elimination roller to approach the roll paper shaft and thereby increase a contact angle ∠PQR of said curl elimination roller with the roll paper, which is defined by a position P where the roll paper drawn out of said roll paper holder comes into contact with said curl elimination roller, a center position Q of said curl elimination roller, and a position R where the roll paper moves away from said curl elimination roller, as the remaining amount of the roll paper decreases.

4. A decurl unit in accordance with claim 1, wherein said shift mechanism linearly moves said curl elimination roller.

5. A decurl unit in accordance with claim 1, wherein said shift mechanism moves said curl elimination roller along a kinked line.

6. A decurl unit in accordance with claim 1, wherein said shift mechanism moves said curl elimination roller along a curve.

7. A decurl unit in accordance with claim 1, wherein said shift mechanism causes a feeding direction of the roll paper from said curl elimination roller to said conveyance roller to be substantially identical with a feeding direction of the roll paper fed out of said conveyance roller, and moves said curl elimination roller parallel or substantially parallel to the feeding direction of the roll paper to approach the roll paper shaft.

8. A decurl unit in accordance with claim 1, said decurl unit further comprising a positioning mechanism that sets said curl elimination roller in either of a curl elimination position where said curl elimination roller is in contact with the roll paper drawn out of said roll paper holder and applies the tension onto the drawn-out roll paper in the decurling direction and a non-curl elimination position where said curl elimination roller applies no tension onto the drawn-out roll paper.

9. A decurl unit in accordance with claim 1, wherein the conveyance roller comprises two rubber rollers that pressingly clip the roll paper and rotate to feed the roll paper held therebetween.

10. A printing device equipped with a decurl unit in accordance with claim 1.

* * * * *